US006883767B1

(12) United States Patent
Huang

(10) Patent No.: US 6,883,767 B1
(45) Date of Patent: Apr. 26, 2005

(54) TOOL SUSPENSION DEVICE

(76) Inventor: Hsu Ju Huang, No. 58, Lane 297-8, Sec. 2, Shtuen Rd., Taichung City (TW) 411

( * ) Notice: Subject to any disclaimer, the term of this patent is extended or adjusted under 35 U.S.C. 154(b) by 0 days.

(21) Appl. No.: 10/626,641

(22) Filed: Jul. 25, 2003

(51) Int. Cl.[7] ..... A47H 1/10
(52) U.S. Cl. ..... 248/317; 211/70.6; 206/378
(58) Field of Search ..... 248/317, 200; 211/70.6, 89.01, 94.01; 206/378

(56) References Cited

U.S. PATENT DOCUMENTS 4,315,422 A * 2/1982 McBride ..... 72/388
5,154,544 A * 10/1992 Arendt ..... 206/375
5,467,874 A * 11/1995 Whitaker ..... 206/378
5,848,832 A * 12/1998 Hsieh ..... 362/119
5,897,001 A * 4/1999 Dembicks ..... 211/70.6
5,975,297 A * 11/1999 Kao ..... 206/378
6,283,311 B1 * 9/2001 Lee ..... 211/70.6
6,508,565 B1 * 1/2003 Wang ..... 362/119

* cited by examiner

*Primary Examiner*—Anita M. King
(74) *Attorney, Agent, or Firm*—Charles E. Baxley

(57) ABSTRACT

A tool suspension device includes a main body having a first side formed with a mounting hole and a second side provided with a mounting portion. The mounting hole of the main body has a periphery formed with a catch edge. The mounting portion of the main body has an inside formed with a mounting space communicating with the mounting hole. Thus, the ratchet wrench can be mounted on and detached from the tool suspension device easily and conveniently, thereby facilitating the user using the ratchet wrench. In addition, the tool suspension device can be reused repeatedly.

7 Claims, 6 Drawing Sheets

TOOL SUSPENSION DEVICE

BACKGROUND OF THE INVENTION

1. Field of the Invention

The present invention relates to a tool suspension device, and more particularly to a tool suspension device that can be reused successively and repeatedly.

2. Description of the Related Art

A conventional tool suspension device in accordance with the prior art shown in FIG. 1 comprises a main body 10, and a fastening strap 12 mounted on the main body 10 for positioning a ratchet wrench 14. Thus, the conventional tool suspension device is placed on a wall or a display board to facilitate the consumers inspecting the ratchet wrench 14.

However, it is necessary to cut off the fastening strap 12 to detach the ratchet wrench 14 from the main body 10. Thus, after the fastening strap 12 is cut off, the conventional tool suspension device cannot be used to hang and position the ratchet wrench 14 any more, thereby causing inconvenience to the user, and thereby limiting the versatility of the conventional tool suspension device.

SUMMARY OF THE INVENTION

The present invention is to mitigate and/or obviate the disadvantage of the conventional tool suspension device.

The primary objective of the present invention is to provide a tool suspension device that can be reused successively and repeatedly.

Another objective of the present invention is to provide a tool suspension device, wherein the positioning ball is locked on the catch edge of the mounting hole of the main body, and the press member is retained by the retaining member, thereby forming a double locking state, so that the ratchet wrench is positioned on the main body of the tool suspension device rigidly and stably without detachment, thereby providing an anti-theft effect.

A further objective of the present invention is to provide a tool suspension device, wherein the ratchet wrench can be detached from the tool suspension device easily and conveniently, thereby facilitating the user using the ratchet wrench.

In accordance with the present invention, there is provided a tool suspension device, comprising:

- a main body having a first side formed with a mounting hole and a second side provided with a mounting portion;
- the mounting hole of the main body has a periphery formed with a catch edge; and
- the mounting portion of the main body has an inside formed with a mounting space communicating with the mounting hole.

Further benefits and advantages of the present invention will become apparent after a careful reading of the detailed description with appropriate reference to the accompanying drawings.

DETAILED DESCRIPTION OF THE INVENTION

Figure 1:
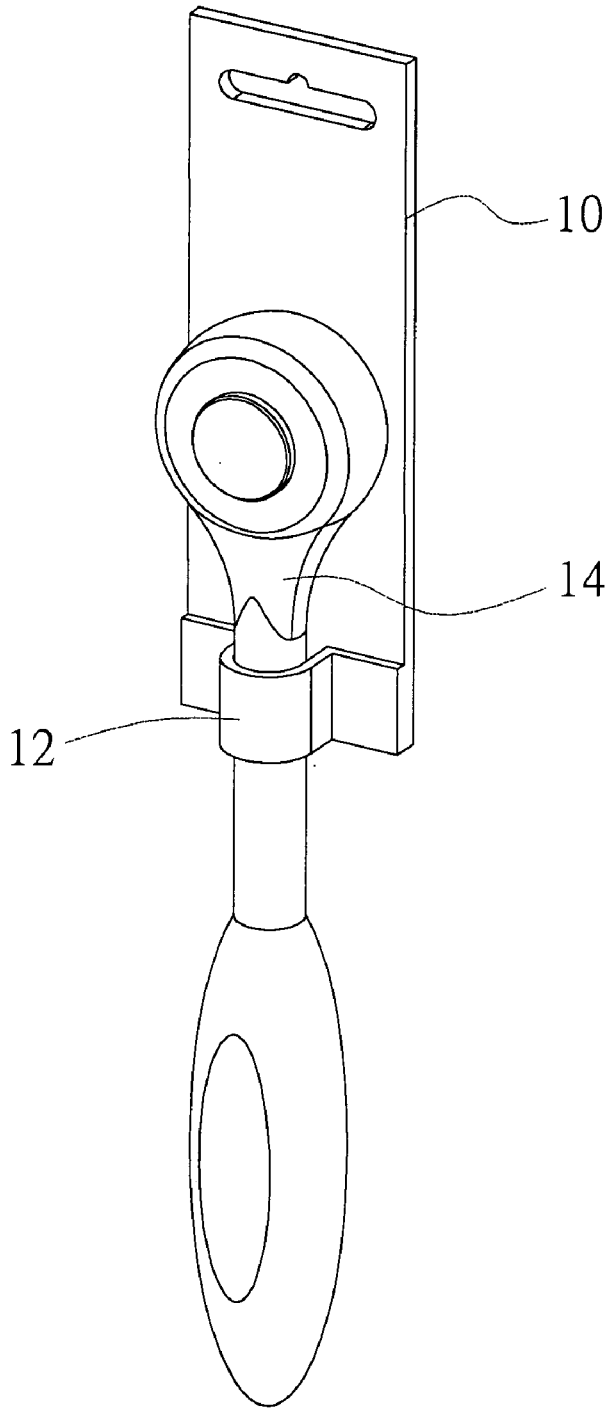
FIG 1 PRIOR ART
FIG. 1 is a perspective view of a conventional tool suspension device in accordance with the prior art.
Figure 2:
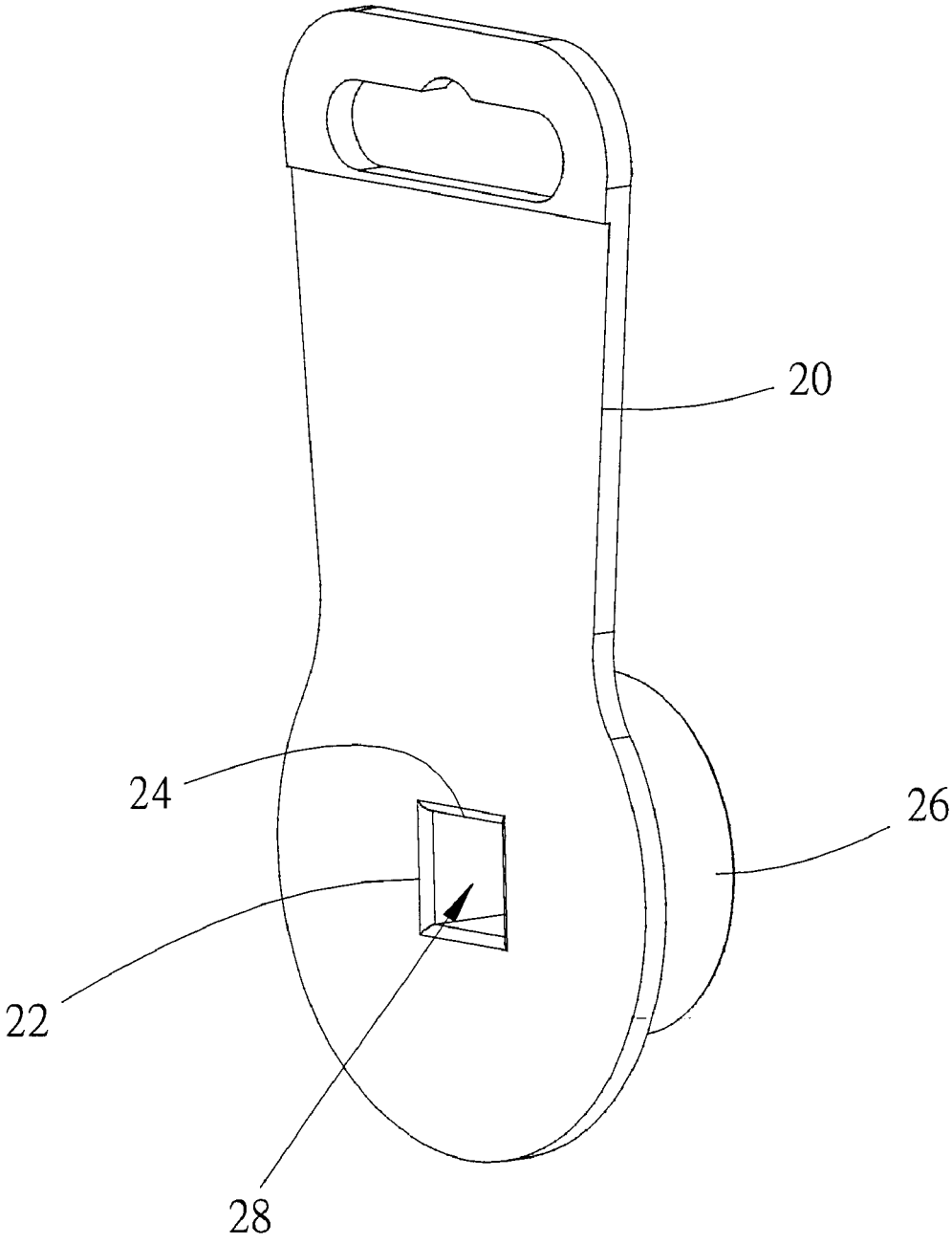
FIG. 2 is a perspective view of a tool suspension device in accordance with the preferred embodiment of the present invention.
Figure 3:
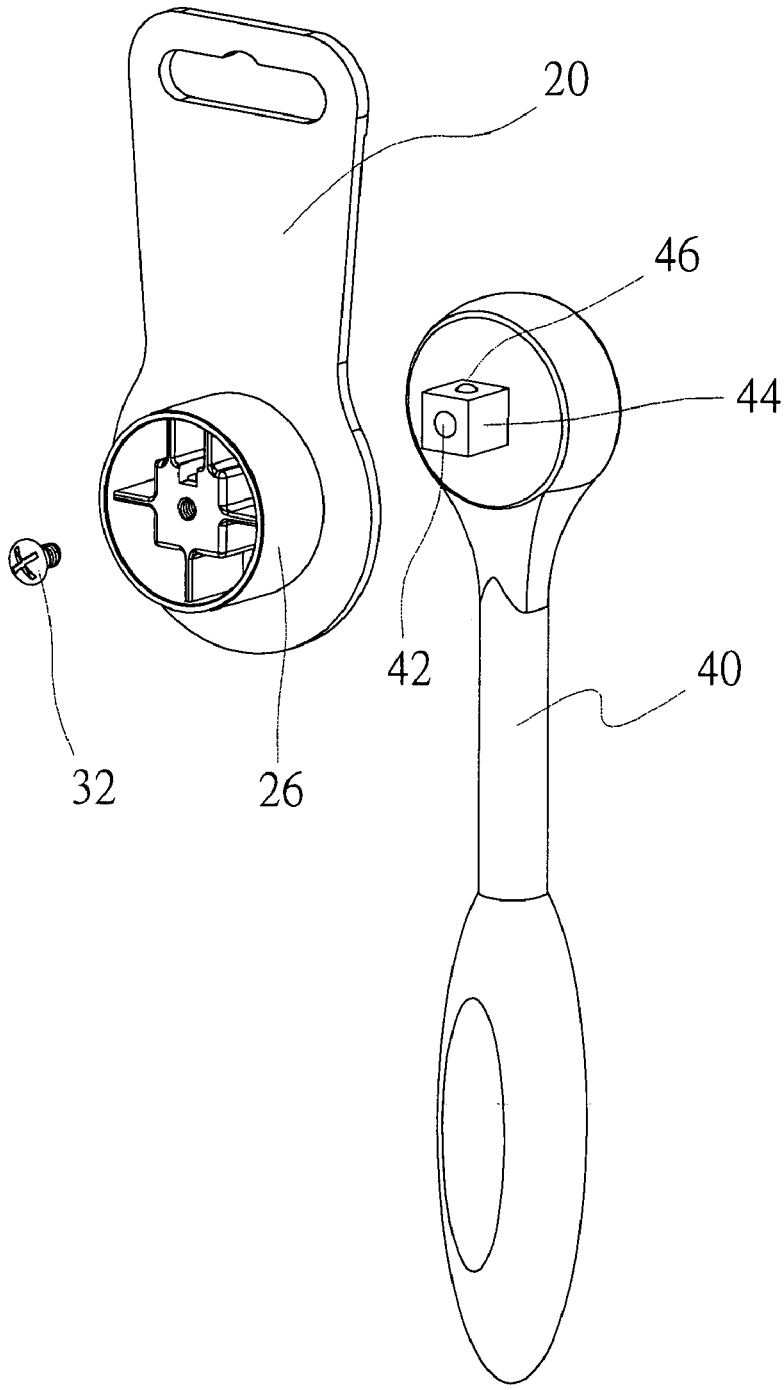
FIG. 3 is a perspective exploded view of the tool suspension device in accordance with the preferred embodiment of the present invention.
Figure 4:
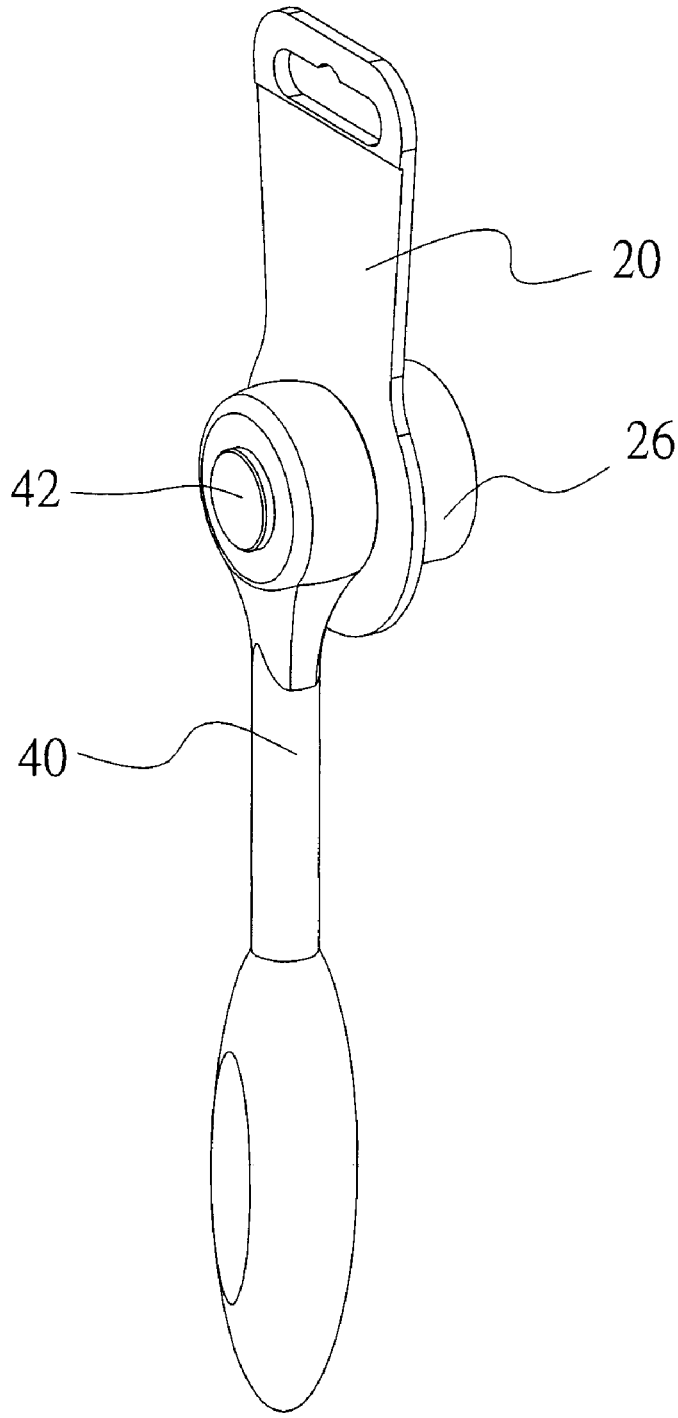
FIG. 4 is a perspective assembly view of the tool suspension device as shown in FIG. 3.

Referring to the drawings and initially to FIGS. 2–5, a tool suspension device in accordance with the preferred embodiment of the present invention comprises a main body 20 having a first side formed with a mounting hole 22 and a second side provided with a mounting portion 26 protruding outward therefrom. The mounting hole 22 of the main body 20 has a periphery formed with a catch edge 24. The mounting portion 26 of the main body 20 has an inside formed with a mounting space 28 communicating with the mounting hole 22. Preferably, the mounting space 28 is directed in an axial direction of the mounting portion 26 of the main body 20.

The tool suspension device further comprises a retaining member 32 mounted on an end face of the mounting portion 26 of the main body 20 and extended into the mounting space 28 of the mounting portion 26 of the main body 20. Preferably, the retaining member 32 is a screw. In practice, a ratchet wrench 40 is mounted on the tool suspension device. The ratchet wrench 40 has a distal end provided with an operation stud 44 mounted in the mounting hole 22 of the main body 20, a positioning ball 46 movably mounted on and protruded outward from a side wall of the operation stud 44, a press member 42 movably mounted in the operation stud 44 and having a first end formed with a enlarged head 420 and a second end formed with a receiving recess 422 to receive the positioning ball 46, and an elastic member 43 urged between the operation stud 44 and the enlarged head 420 of the press member 42.

Figure 5:
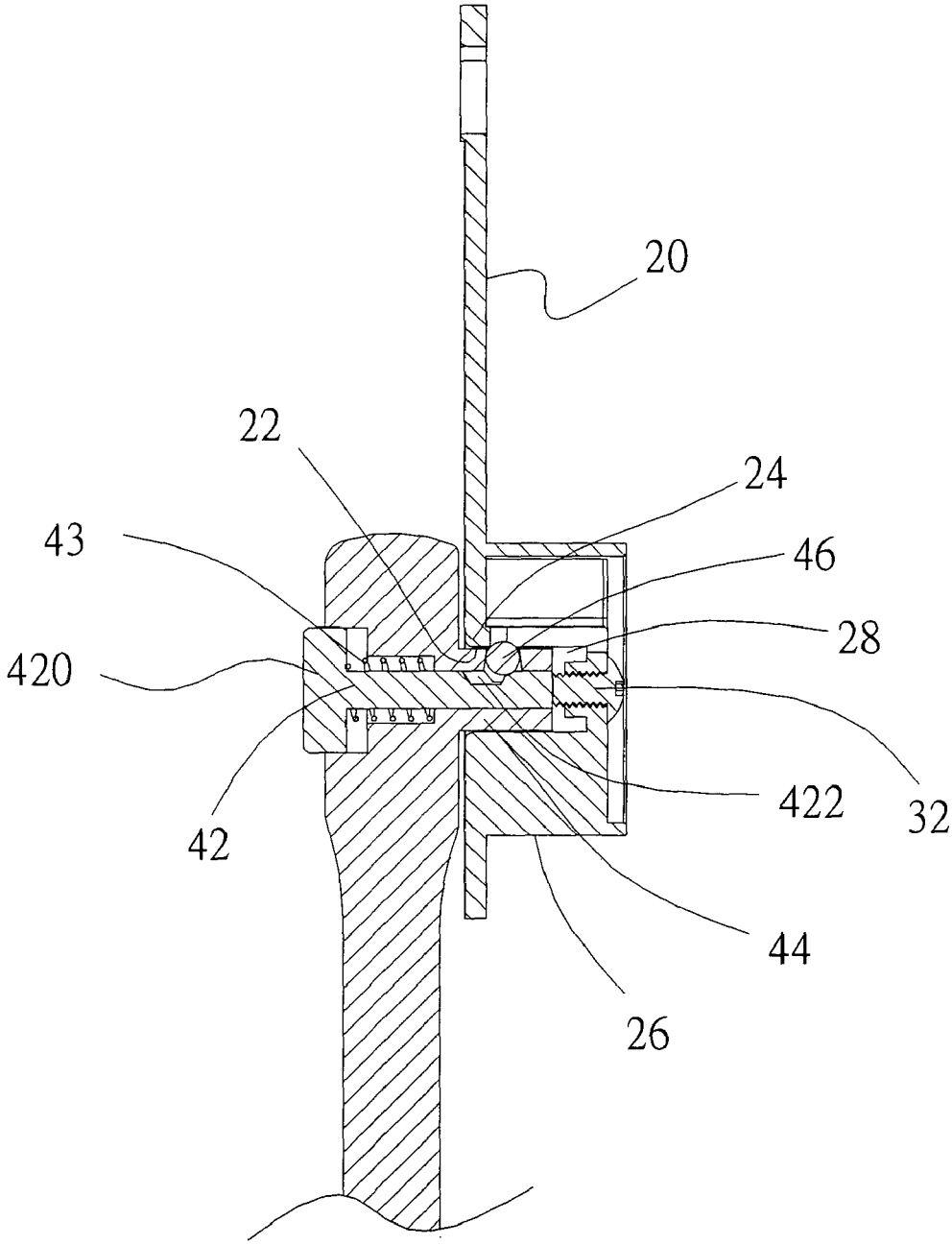
FIG. 5 is a partially cut-away side plan cross-sectional view of the tool suspension device as shown in FIG. 4.

In assembly, the enlarged head 420 of the press member 42 is pressed by a force to move the press member 42 into the operation stud 44 until the receiving recess 422 of the press member 42 aligns with the positioning ball 46, so that the positioning ball 46 is received in the receiving recess 422 of the press member 42 and is retracted into the side wall of the operation stud 44. Then, the operation stud 44 is inserted into the mounting hole 22 of the main body 20 and is received in the mounting space 28 of the mounting portion 26 of the main body 20. Then, after the force applied on the enlarged head 420 of the press member 42 is removed, the press member 42 is moved outward relative to the operation stud 44 by the restoring force of the elastic member 43, so that the positioning ball 46 is pressed and moved outward by the wall of the receiving recess 422 of the press member 42 to protrude outward from the side wall of the operation stud 44 and to abut the catch edge 24 of the mounting hole 22 of the main body 20 as shown in FIG. 5, thereby forming a locking state by engagement of the positioning ball 46 with the catch edge 24 of the mounting hole 22 of the main body 20. Then, the retaining member 32 is secured on the end face of the mounting portion 26 of the main body 20 and is rested on the second end of the press member 42 to retain the press member 42, thereby forming a double locking state by engagement of the retaining member 32 with the press member 42, so that the press member 42 cannot be pressed and moved, and the positioning ball 46 will not detach from the catch edge 24 of the mounting hole 22 of the main body 20.

Accordingly, the positioning ball 46 is locked on the catch edge 24 of the mounting hole 22 of the main body 20, and the press member 42 is retained by the retaining member 32, thereby forming a double locking state, so that the ratchet wrench 40 is positioned on the main body 20 of the tool suspension device rigidly and stably without detachment, thereby providing an anti-theft effect efficiently.

Figure 6:
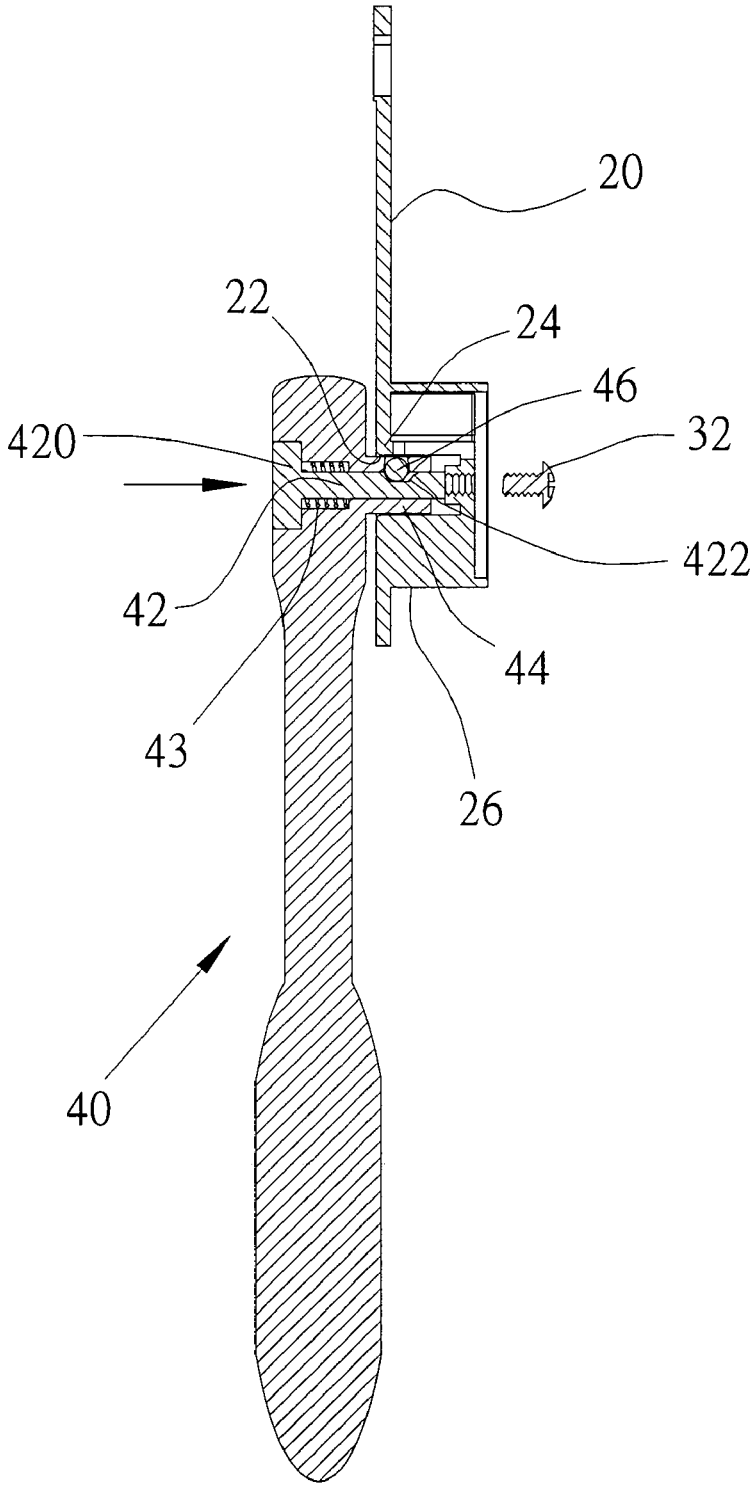
FIG. 6 is a schematic operational view of the tool suspension device as shown in FIG. 5.

As shown in FIG. 6, the retaining member 32 is detached from the end face of the mounting portion 26 of the main body 20 to release the second end of the press member 42 from the retaining member 32, so that the enlarged head 420 of the press member 42 is pressed by a force to move the press member 42 into the operation stud 44 until the receiving recess 422 of the press member 42 aligns with the positioning ball 46, such that the positioning ball 46 is received in the receiving recess 422 of the press member 42 and is retracted into the side wall of the operation stud 44. At this time, the positioning ball 46 is detached from the catch edge 24 of the mounting hole 22 of the main body 20, thereby forming an unlocking state, so that the operation stud 44 can be detached from the mounting hole 22 of the main body 20, thereby releasing the ratchet wrench 40 from the main body 20 of the tool suspension device easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool suspension device, comprising:

a main body having a first side formed with a mounting hole and a second side provided with a mounting portion;

the mounting hole of the main body having a periphery formed with a catch edge;

the mounting portion of the main body having an inside formed with a mounting space communicating with the mounting hole; and a retaining member mounted on an end face of the mounting portion of the main body and extended into the mounting space of the mounting portion of the main body, wherein the retaining member is a screw.

2. The tool suspension device in accordance with claim 1, wherein the mounting portion protrudes outward from the second side of the main body.

3. The tool suspension device in accordance with claim 1, wherein the mounting space is directed in an axial direction of the mounting portion of the main body.

4. A tool suspension device, comprising:

a main body having a first side formed with a mounting hole and a second side provided with a mounting portion;

the mounting hole of the main body having a periphery formed with a catch edge;

the mounting portion of the main body having an inside formed with a mounting space communicating with the mounting hole; and a ratchet wrench mounted on the main body and including a distal end provided with an operation stud mounted in the mounting hole of the main body, and a positioning ball protruded outward from a side wall of the operation stud and rested on the catch edge of the mounting hole of the main body.

5. The tool suspension device in accordance with claim 4, wherein the ratchet wrench further includes a press member movably mounted in the operation stud and having a first end formed with a enlarged head and a second end formed with a receiving recess to receive the positioning ball, and an elastic member urged between the operation stud and the enlarged head of the press member.

6. The tool suspension device in accordance with claim 5, further comprising a retaining member mounted on an end face of the mounting portion of the main body and extended into the mounting space of the mounting portion of the main body, wherein the retaining member is rested on the second end of the press member to retain the press member, thereby forming a locking state by engagement of the retaining member with the press member, so that the press member cannot be pressed and moved, and the positioning ball will not detach from the catch edge of the mounting hole of the main body.

7. The tool suspension device in accordance with claim 4, wherein the operation stud is inserted through the mounting hole of the main body into the mounting space of the mounting portion of the main body.

* * * * *